US005269426A

United States Patent [19]

Morano

[11] Patent Number: 5,269,426

[45] Date of Patent: Dec. 14, 1993

[54] BABY FEEDING BOTTLE WITH HOOD STORAGE

[75] Inventor: Emanuel P. Morano, Totawa, N.J.

[73] Assignee: Playtex Family Products Corporation, Stamford, Conn.

[21] Appl. No.: 933,438

[22] Filed: Aug. 20, 1992

[51] Int. Cl.[5] ..... A61J 9/00

[52] U.S. Cl. ..... 215/11.6; 215/272; 220/306

[58] Field of Search ..... 215/11.6, 272, 317, 215/321, 228; 220/379, 212, 306

[56] References Cited

U.S. PATENT DOCUMENTS

| | | | |
|---|---|---|---|
| 1,429,585 | 9/1922 | Hagerty . | |
| 1,649,580 | 11/1927 | Geisler | 215/11.6 |
| 3,627,161 | 12/1971 | Wergeland | 215/11.6 |
| 3,762,542 | 10/1973 | Grimes . | |
| 3,822,806 | 7/1974 | Grimes . | |
| 4,230,230 | 10/1980 | Mumford | 215/321 |
| 4,238,040 | 12/1980 | Fitzpatrick | 215/274 X |
| 4,346,815 | 8/1982 | Raymor et al. | 215/321 X |
| 4,533,057 | 8/1985 | Klittich . | |
| 4,815,615 | 3/1989 | Phlaphongphanich | 215/11.6 X |
| 5,020,680 | 6/1991 | Bale | 215/11.6 |

FOREIGN PATENT DOCUMENTS

| | | | |
|---|---|---|---|
| 0704752 | 3/1965 | Canada | 215/11.6 |
| 0061868 | 10/1982 | European Pat. Off. | 215/11.6 |

OTHER PUBLICATIONS

"A Match Made in Heaven"—Playtex and Cherubs 1990 Product Catalog—GPO 5052.

*Primary Examiner*—Allan N. Shoap
*Assistant Examiner*—Stephen Cronin
*Attorney, Agent, or Firm*—Abelman, Frayne & Schwab

[57] ABSTRACT

A baby bottle feeding assembly is disclosed which includes a hood type enclosure for the nipple, when the bottle is not in use. During periods of bottle use, the hood is stored over the opposite end of the bottle. In order to positively retain the hood in either its nipple protecting or storage condition, the hood includes raised beads, which cooperatively engage complementary protrusions at either end of the bottle so as to provide a positive locking engagement. This engagement may be manually defeatable when it is desired to move the hood to its other desired position on the bottle. When the hood is locked in the storage condition, it is substantially co-extensive with the bottom region of the bottle, so as not to significantly extend beyond the bottle proper.

20 Claims, 2 Drawing Sheets

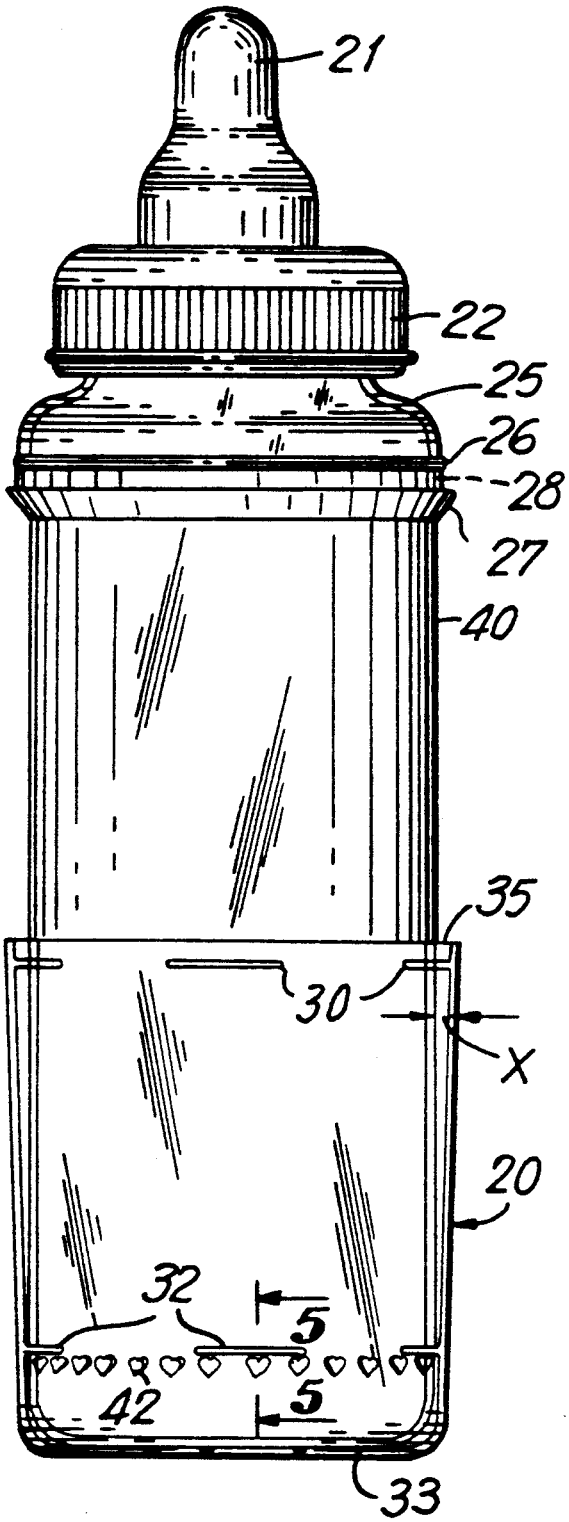
FIG. 3
FIG. 4
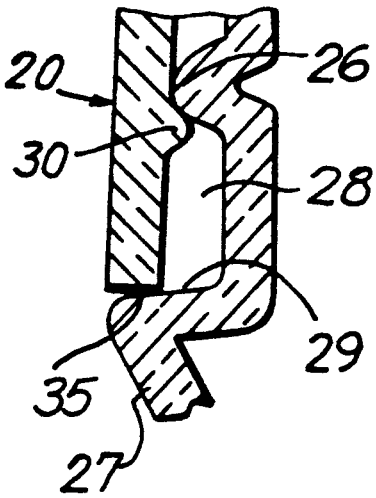
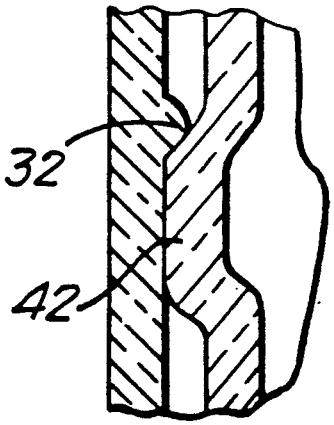
FIG. 5
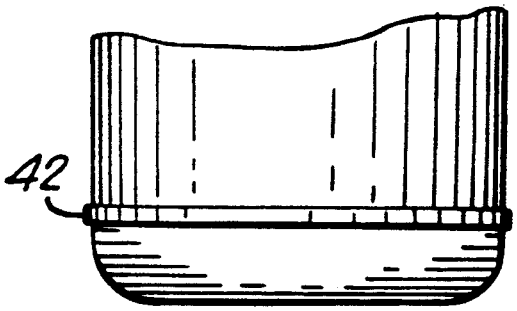
FIG. 6

BABY FEEDING BOTTLE WITH HOOD STORAGE

This invention relates to an infant or baby feeding system of the type which includes: a bottle for containment of the liquid to be fed to the infant or baby; a liquid withdrawal means, such as a nipple, which is removably secured to one end of the bottle, and; a hollow hood for protectively covering the nipple against contamination or leakage when the bottle is not in use. An improved arrangement is provided for positively securing the hood over the nipple, or, alternatively, during periods of bottle use, positively securing the hood at a storage position at the opposite end of the bottle. In either of its positions, the hood is locked in place to prevent inadvertent displacement of its hood from its desired position, by a manually defeatable engagement of a protrusion at one end of the bottle, and one of a pair of spaced beads on the hood.

BACKGROUND OF THE INVENTION

Baby feeding unit arrangements of the general type described herein are known. Typically, such units comprise a nursing holder wherein the protective cap is retained only by friction in one or both of its positions. For example, U.S. Pat. No. 4,238,040, assigned to the assignee of the instant application, shows such a hood 17 which the open end is force fitted over a raised lip of the bottle to maintain the cap in its protective position, but is frictionally retained in its storage position at the opposite end of the bottle. U.S. Pat. Nos. 3,762,542 and 3,822,806, show other nursing units, of the type like U.S. Pat. No. 4,238,040 which include a collapsible sac for holding the feeding liquid, in which the hood is frictionally retained over the nipple in its protective position. When it is desired to store the hood, it is positioned within the open end of the rigid holder, with the outer frontal portion of the hood being similarly frictionally retained by the lower internal side walls of the holder. U.S. Pat. No. 5,020,680 shows a somewhat modified arrangement wherein the protective hood is frictionally retained either at the top of the bottle, when it is desired to protect the nipple, or over the bottom end of the bottle during its storage condition. U.S. Pat. No. 3,627,161 similarly shows the inclusion of a protective cap in conjunction with a nursing bottle, in which the protective cap, which also includes a music box, is only frictionally engaged with the bottle at either its nipple protective or opposed storage position. U.S. Pat. No. 4,533,057 maintains the hood in its protective position by providing the hood with internal threads for cooperative engagement with complementary bottle threads. However, that hood is stored at the bottom of the bottle by frictionally retaining its forward most projection within a complementary central recess.

It should really be appreciated that a more positively engagement is desired than the frictional securement typically practiced in many present nurser bottles. This is desired both to prevent inadvertent removal of the cap when the bottle is not in use, which can result in both nipple contamination and undesirable leakage in the bottle. The bottle might typically be carried by the caring adult in a traveling bag which could include clothing or other articles. Likewise, when the bottle is being used by the infant or small child, it is desired that the cap remain in its storage location so as to be accessible, but not inadvertently fall out, or be capable of removal by the infant or small child.

Recognizing an early desire to have a more positive securement of the protective cap at its two locations, U.S. Pat. No. 1,429,585 shows the threaded engagement of the hood to the bottle in both its protective and storage conditions. U.S. Pat. No. 1,649,580 has a specially designed hood which includes a series of spring fingers at its lower end to resiliently engage annular beads at either end of the bottle. It should be noted, however, that in addition to the complexities and additional manufacturing costs occasioned by these suggested solutions to the instant and long recognized problem, when the protective hood is in its storage condition, the entire length projects downward beyond the lower extreme of the bottle, thereby undesirably creating a more cumbersome bottle assembly for feeding the infant or small child. Hence, while the prior art has recognized the desirability of providing for secure engagement and convenient storage of the protective hood used in conjuction with baby bottles, there has usually been a sacrifice of one or more of the desired end results.

BRIEF STATEMENT OF THE INVENTION

The baby feeding bottle assembly of the present invention is provided with a protective hood which has a pair of longitudinally spaced internally projecting beads at its open and closed end regions. These beads in turn cooperatively ride over and inter-engage complementary protrusions at the opposed ends of the bottle, so as to provide a positive, easily manually defeatable, engagement of the hood and the bottle when the hood is either: positioned at the top of the bottle wherein it protectively overlies the nipple, or; stored over the bottom end of the bottle wherein the major longitudinal extent of the hood extends over, rather than extending beyond, the bottom region of the bottle.

Advantageously, when the hood is in the nipple protecting position, the locking bead is located within an annular recess of the bottle, which communicates with an outwardly extending projection. This projection abuts the open end wall of the hood to serve as a stop for limiting its downward movement.

As a further preferable feature, the inner diameter of the hood between its storage engaging bead (at its closed end) and its open end is of a greater diameter than the outside wall of the portion of the bottle which it overlies in the storage position, so that there is clearance between the bottle and the major longitudinal walls of the hood while it is in the storage condition.

OBJECTS

It is accordingly a primary object of the present invention to provide a baby bottle feeding assembly which includes a manually defeatable, locking engagement, of the protective hood at both the nipple enclosing protective condition and storage condition.

A further object of the instant invention is to provide such a baby bottle feeding system in which the hood includes a pair of longitudinally spaced internally projecting bead means, which engage complementary protrusions at the top or bottom ends of the bottle, to positively maintain the hood in its desired position.

An additional object of the present invention is to provide such a baby bottle feeding system, which further includes an abutment means at its top end, for limiting the downward movement between the hood on the bottle, and maintain the hood in its desired location.

Still a further object of the instant invention is to provide such a baby bottle feeding system, which includes a protective hood, in which the hood is locked in its storage position, while it is substantially co-extensive with the lower region of the bottle, and an annular gap is provided between the outside wall of the bottle and inside wall of the hood.

THE DRAWINGS

In order to describe the invention more fully, attention is directed to the accompanying drawings in which:

FIG. 3 is a front view, corresponding to FIG. 1, but with the hood shown in the storage position, corresponding to the bottle being in use.

FIG. 4, is a detail showing the locking, and abutting interengagement of the hood and the bottle when the hood is in the nipple protective position of FIGS. 1 and 2.

FIG. 5 is a detail showing the locking engagement of the hood and bottle when the hood is in the storage condition of FIG. 3.

FIG. 6 shows an alternate embodiment of the locking protrusion means provided at the lower end of the bottle for maintaining the hood in its storage condition.

DETAILED DESCRIPTION OF THE PREFERRED EMBODIMENTS

Figure 1:
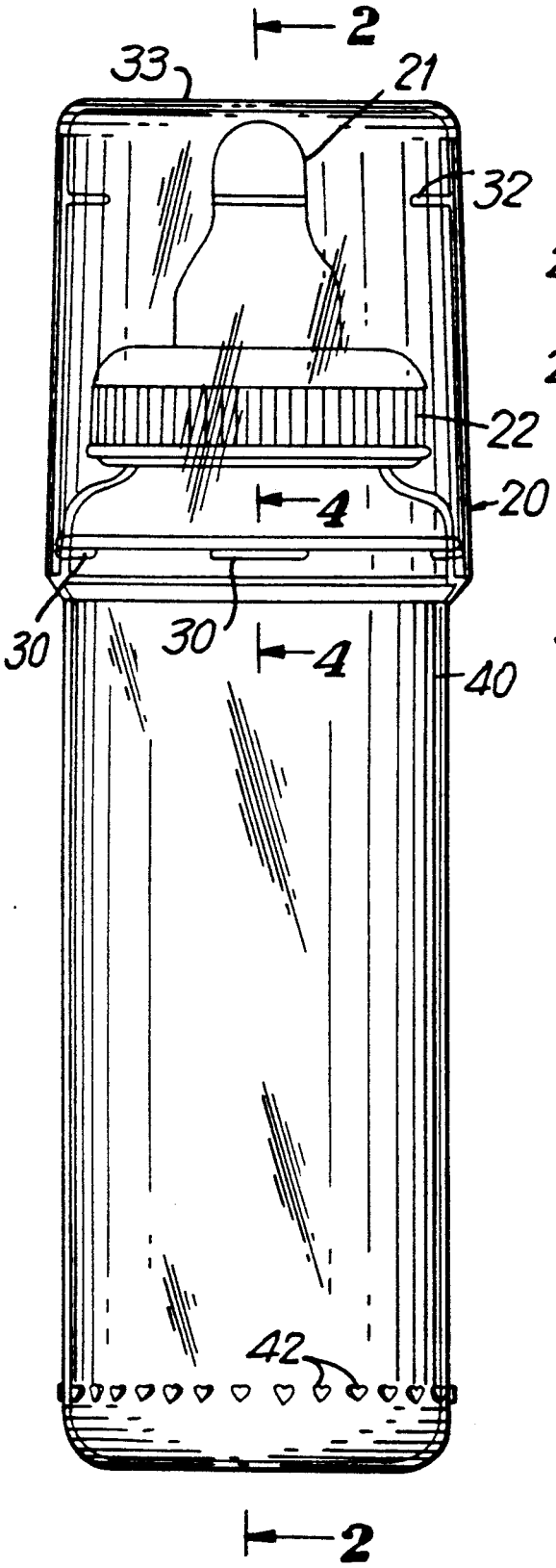
FIG. 1 is a front view of a first embodiment of the instant invention in which the hood is shown in the nipple protecting position.
Figure 2:
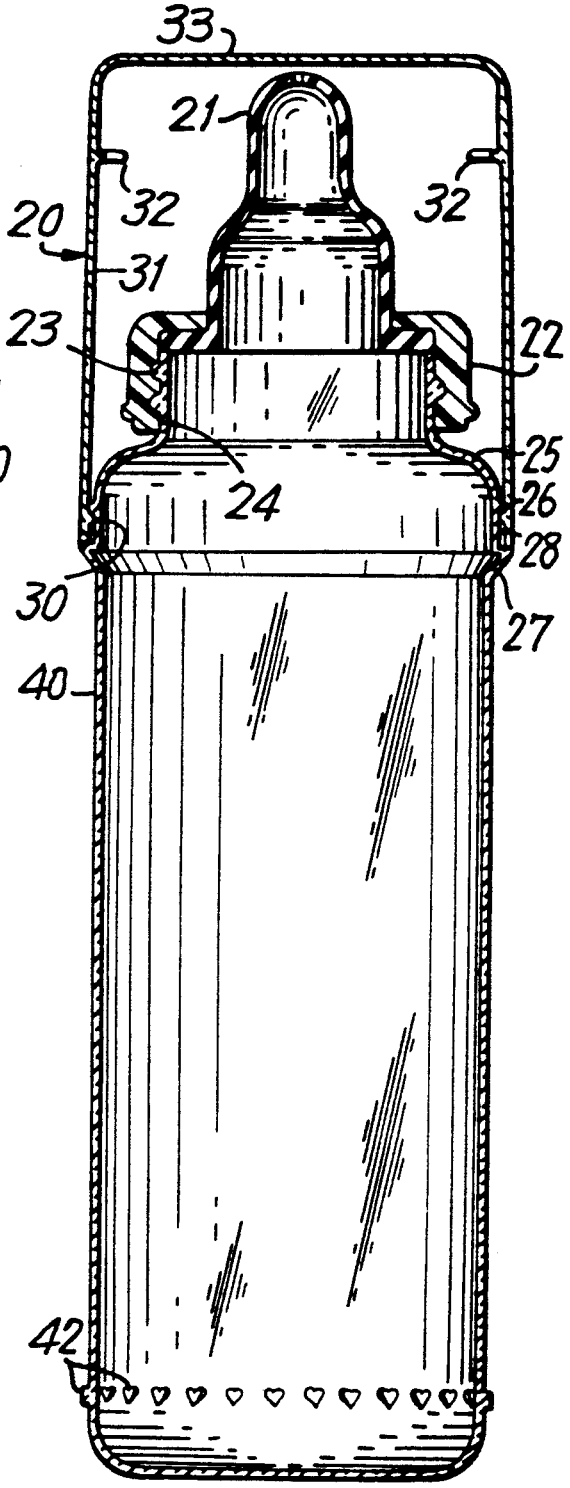
FIG. 2 is a cross-sectional view of FIG. 1.

Reference is first made to FIGS. 1, 2 and 4, which shows the baby bottle assembly of the instant invention in one of its conditions, namely with the hood 20 being positioned over the nipple 21 for protection thereof. Nipple 21 which includes ate at portion at its forward and, is typically shown secured by ring 22 over its lower skirt which engages threads 23 at the narrowed open upper end of the nursing bottle 40. Nursing bottle 40 may typically be formed of a molded plastic material as is well known in the art. However, if desired, it may be formed of glass. Further, while nursing bottle 40 is shown of the type which contains the liquid directly therein, the present invention may also be practiced with the nursing systems of the type which include an individual collapsible sac which contains the liquid to be fed to the child, with said sac being placed over the top of a rigid container, and supported thereby, as is shown in aforementioned U.S. Pat. Nos. 4,238,040, 3,762,942 and 3,822,806.

The rigid nursing bottle 40, in accordance with the present invention includes an annular protrusion 26 at its upper end with an annular recess 28 immediately there-below, which in turn communicates with a second annular protrusion 27. As noted in FIG. 4, protrusion 27 extends beyond protrusion 26 and includes a top surface 29, for purposes which will be subsequently discussed.

Somewhat displaced from the open extreme of hood 20 are a series of spaced inwardly extending beads 30. However, if desired, the beads 30 may be joined as a continually extending ring. When the cap 20 is in the condition shown in FIGS. 1, 2, and 4 the inherent resiliency of the side walls 31 of the hood 20 permits the beads 30 to ride over the bottle protrusion 26 and snap into annular recess 28, so as to provide a positive structural lock for maintaining the hood, in that position, wherein it provides protection of the forward end of the nipple 21. The bead 30 is predeterminately located longitudinally inward of the end extreme or wall 35 of hood 20 so as to cooperatively provide, in conjunction with protrusion 27, a positive stop for the downward movement of the hood 20 on the bottle 40. As best shown in FIG. 4, outwardly extending annular protrusion 27 intentionally extends significantly beyond locking protrusion 26 a sufficient amount to inhibit the cap from resiliently riding over beyond this point. Protrusion 27 includes a top ledge 29 which establishes an abutting stop against the open end wall 35 of the cover, while bead 30 is positioned in the annular recess between protrusions 26 and 27. It should be readily appreciated that in this condition the cap will not inadvertently be displaced, which might occur if it were only frictionally maintained.

When it is desired to utilize the baby bottle assembly for feeding the infant, the cap is manually removed by an adult by moving it upward such that the beads 30 will ride over protrusions 26 to release the cap from the bottle. In order to avoid inadvertent misplacement of the cap it is then advantageously placed in the storage condition, shown in FIGS. 3 and 5. To similarly positively engage the cap in this storage condition, the cap includes a second set of inwardly extending beads 32 at its closed end region. Although shown as discrete elements, these beads may be joined to form a continuous annular ring. The bottle protrusion means are provided by outwardly extending members 42. As contrasted to the continuous annular protrusion 26 shown at the top end of the bottle, protrusion means 42 may be individual members, such as the heart shaped elements shown in FIG. 3. This is purely for aesthetic purposes and, if desired, these protrusions may be formed of a continuous annular extension, such as 42 shown in the alternative embodiment of FIG. 6. The displacement between bead 32 and the closed end 33 of the cap substantially corresponds to the displacement between the top end of bottle protrusion 42 and the lower terminus of the bottle. Accordingly, when the cap is in the storage position shown in FIG. 3, it is substantially co-extensive with the bottom region of the bottle, such that it does not increase the overall length during the storage condition, as had typically been required by the prior art locking storage structures shown in aforementioned U.S. Pat. Nos. 1,429,585 and 1,649,580. Further, the outer diameter of the holder 40, at least along the substantial portion of its lower region where the cap extends thereover, as shown in FIG. 3, is predeterminately less than the inner diameter of the cap 20 so as to provide the gap, as shown by X. This serves to minimize the frictional engagement between the cap and the bottle when the cap is moved to the storage position. Further, since it is popular to include pictorial decoration on the outer surface of the holder, this gap serves to prevent the scraping off of such decoration during the movement of the cap with respect to the storage condition.

Both the holder 40 and cap 20 are preferably formed of a moldable plastic which may either a thermoforming or thermosetting material. Through use of such a material the various beads, projections and recesses, can be effectively and accurately intricately formed in a single molding operation.

Numerous modifications and variations of this invention may be made without departing from the spirit and scope thereof. It is understood, therefore, that this invention is not limited to the specific disclosure herein, but to the appended claims.

What is claimed is:

1. A baby feeding bottle assembly comprising:

a generally elongated hollow nursing holder including inner and exterior wall surfaces longitudinally extending between a first upper end and a second lower end, said first end being open, terminating at a first end terminus, and including a nipple receiving means, and said second end terminating at a second end terminus, a first protrusion at said first end, longitudinally displaced from said nipple receiving means towards said second end, and peripherally extending outward from the adjacent exterior wall surfaces of the nursing holder, a second protrusion at said second end, longitudinally displaced from the second end terminus of the nursing holder towards said first end, and peripherally extending outward from the adjacent exterior wall surfaces of the nursing holder, a nipple for detachable securement to said nipple receiving means at said first end of the nursing holder, and including a teat portion projecting beyond said first end, a hollow hood for protectively covering said nipple, said hood including inner and exterior wall surfaces longitudinally extending between a first open end and a closed second end, said first end terminating at a first end terminus and said second end terminating at a second end terminus, said hood including longitudinally spaced first and second inwardly projecting beads said first inwardly projecting bead adjacent said first open end of the hood and peripherally extending inward of the adjacent inner wall surfaces of the hood, and said second inwardly projecting bead adjacent said closed second end of the hood, and peripherally extending inward of the adjacent inner wall surfaces of the hood, said hood being manually movable between a first nipple protecting position over said first end of the nursing holder and a second storage position over said second end of the nursing holder, said first position characterized by said first bead of the hood positioned longitudinally below said first protrusion of the nursing holder, with said first protrusion and first bead combinedly providing a positive locking abutment to maintain the hood in said first position, the removal of the hood from said first position requiring the riding of said first bead over said first protrusion in the direction of the first end of the nursing holder to defeat the locking abutment relationship, said second position characterized by said second bead of the hood positioned longitudinally above said second protrusion of the nursing holder, with said second protrusion and second bead combinedly providing a locking abutment to positively maintain said hood in said second storage position, an area defined by the inner wall surfaces of said hood exceeding an area defined by the exterior wall surfaces of the holder at its lower end region co-extensive with the longitudinal extent of the hood, such that substantially the entire length of said hood is positioned longitudinally upward of the second end terminus of the nursing holder and overlies said nursing holder.

2. The baby bottle assembly of claim 1, wherein said first end of said nursing holder including an inwardly extending peripheral recess longitudinally below said first protrusion, said first bead located within said recess when said hood is in said first position.

3. The baby bottle assembly of claim 2, wherein said nursing holder further including a third protrusion at said first end, positioned longitudinally below said recess in the direction of said second end, said third protrusion extending outward of said exterior wall surface of the nursing holder beyond the outward extent of said first protrusion, the longitudinal separation between said first and third protrusions is substantially equal to the longitudinal separation between said first bead and said first end terminus of said hood, the first end terminus of the hood abutting said third protrusion when said hood is in said first position to provide a positive stop to prevent the further downward movement of said hood towards the second end of the nursing holder.

4. The baby bottle assembly of claim 1, wherein said nursing holder further including a third protrusion at said first end, longitudinally below said first protrusion in the direction of said second end, said third protrusion extending outward of said exterior wall surface of the nursing holder beyond the outward extent of said first protrusion, the longitudinal separation between said first and third protrusions is substantially equal to the longitudinal separation between said first bead and said first end terminus of said hood, the first end terminus of the hood abutting said third protrusion when said hood is in said first position to provide a positive stop to prevent the further downward movement of said hood towards the second end of the nursing holder.

5. The baby bottle assembly of claim 1, wherein said nursing holder and hood are cylindrical.

6. The baby bottle assembly of claim 5, wherein said first bead consists of a series of circumferentially spaced narrow tab like projections forming an inner ring at the first open end region of the hood.

7. The baby bottle assembly of claim 5, wherein said second bead consists of a series of circumferentially spaced narrow tab like projections forming an inner ring at the second closed end region of said hood.

8. The baby bottle assembly of claim 5, wherein said second protrusion consists of a series of circumferentially spaced projections forming an outer ring at said second end region of the said nursing holder.

9. The baby bottle assembly of claim 5, wherein said first bead consists of a series of circumferentially spaced narrow tab like projections forming an inner ring at said first open end region of the hood, said second bead consists of a series of circumferentially spaced narrow tab like projections forming an inner ring at said second closed end region of said hood, said second protrusion consists of a series of circumferentially spaced projections forming an outer ring at said second end region of the said nursing holder.

10. The baby bottle assembly of claim 1, wherein said hood is formed of a plastic material which is adapted to be resiliently stressed as said first or second bead passes over its respective first or second protrusion and to snap back into its non-stressed condition in said first or second positions, to inhibit removal of said hood in either said nipple protecting first position or second storage position.

11. The baby bottle assembly of claim 10, wherein said first end of said nursing holder including an inwardly extending peripheral recess longitudinally below said first protrusion, said first bead located within said recess when said hood is in said first position, said nursing holder further including a third protrusion at said first end, longitudinally below said first protrusion, said third protrusion extending outward of said exterior wall surface of the nursing holder beyond the outward extend of said first protrusion, the longitudinal separation between said first and third protrusions is substantially equal to the longitudinal separation between said first bead and said first end terminus of said hood, the first end terminus of the hood abutting said third protrusion means when said hood is in said first position to provide a positive stop to prevent further downward movement of said hood towards the second end of the nursing holder.

12. The baby bottle assembly of claim 11, wherein said first bead consists of a series of circumferentially spaced narrow tab like projections forming an inner ring at said first end region of the hood, and said second bead consists of a series of circumferentially spaced narrow tab like projections forming an inner ring at said second end region of said hood.

13. The baby bottle assembly of claim 12, wherein said second protrusion consists of a series of circumferentially spaced projections forming an outer ring at said second end region of the said nursing holder.

14. The baby bottle assembly of claim 10, wherein said nursing holder and hood are cylindrical, the inner diameter of said hood between said first and second bead exceeding the outer diameter of said nursing holder second end region which is coextensive with the longitudinal extent of said hood, whereby an annular gap is provided between the inner cylindrical wall of said hood and the exterior cylindrical wall of said nursing holder when said hood is in said second storage position.

15. A feeding container assembly comprising, a hollow cylindrical container to receive liquid, said container having an open first upper end including a liquid withdrawal means, and an opposed closed second lower end, longitudinally spaced first and second outwardly extending shoulders at the first end of the container, with an inwardly extending annular recess therebetween, said first shoulder being displaced from said second shoulder in the direction of said second container end, and extending outward of the adjacent container wall surfaces significantly beyond the radial extent of said first shoulder, an annular protrusion at the second end region of the container a hollow cylindrical hood for protectively covering said liquid withdrawal means, said hood including a first open end, terminating at a first end terminus, and a closed second end, said hood including first and second inwardly projecting annular beads at its respective first and second ends, said hood being manually movable between a first protecting position in which said first annular bead is positioned below said first shoulder and within said annular recess, the first end terminus of the hood abuts said second shoulder, and the closed second end of the hood overlies the liquid withdrawal means, and a second storage position, in which said annular bead is positioned immediately above said annular protrusion, the inner diameter of said hood exceeding the outer diameter of said container at its lower region coextensive with the longitudinal extent of the hood, such that said hood overlies the lower portion of the container in said second position, whereby the inter-engagement of one of the hood beads with either the first shoulder in its first protective position, or the annular protrusion in its second storage position, selectively provides manually defeatable locking securement of the hood to the container in both of said positions.

16. The feeding container assembly of claim 15, wherein said first bead consists of a series of circumferentially spaced narrow tab like projections forming an inner ring at said first end of the hood, and said second bead consists of a series of circumferentially spaced narrow tab like projections forming an inner ring at said second end of said hood.

17. The feeding container assembly of claim 15, wherein said hood is formed of a plastic material which is adapted to be resiliently stressed as said first or second bead passes over its respective first shoulder or annular protrusion, and to snap back into its non-stressed condition in said first or second positions, to inhibit removal of said hood in either said protecting first position or second storage position.

18. The feeding container assembly of claim 17, wherein the inner diameter of said hood between said first and second beads sufficiently exceed the outer diameter of said container second end which is coextensive within the longitudinal extent of said hood, such that an annular gap is provided between the inner cylindrical wall of said hood and outer cylindrical wall of said container when said hood is in said second storage position.

19. The feeding container assembly of claim 18, wherein said annular protrusion consists of a series of circumferentially spaced projections forming an outer ring at said second end of the said container.

20. The feeding container assembly of claim 15, wherein the inner diameter of said hood between said first and second beads sufficiently exceed the outer diameter of said container second end which is coextensive with the longitudinal extent of said hood, such that an annular gap is provided between the inner cylindrical wall of said hood and outer cylindrical wall of said container when said hood is in said second storage position.

* * * * *